United States Patent [19]

Shigehara

[11] 4,234,865

[45] Nov. 18, 1980

[54] TRANSFORMER FRAMING STRUCTURE

[76] Inventor: Katsumi Shigehara, 29-15, Higashikashiwagaya 2-chome, Egina-shi,Kanagawa-ken, Japan

[21] Appl. No.: 56,094

[22] Filed: Jul. 9, 1979

[51] Int. Cl.[3] ..... H01F 27/02; H01F 27/30

[52] U.S. Cl. ..... 336/92; 336/192; 336/198

[58] Field of Search ..... 336/90, 92, 105, 107, 336/192, 198, 208; 242/118.41; 310/194

[56] References Cited

U.S. PATENT DOCUMENTS 3,213,397 10/1965 Broverman ..... 336/198 X

FOREIGN PATENT DOCUMENTS 1250827 10/1971 United Kingdom ..... 336/198

*Primary Examiner*—Thomas J. Kozma
*Attorney, Agent, or Firm*—Marshall & Yeasting

[57] ABSTRACT

A transformer framing structure in which the distance between the opposing end faces of the primary and secondary coils is increased to improve the dielectric strength of the transformer, and also the primary and secondary coils are framed by separate frameworks to allow separate winding of the respective coils to thereby improve assembling workability. According to this invention, the number of the dies used for molding of the frame body, bobbin assembly and cover of the framing structure is lessened, and mounting of the terminals is simplified to allow easy terminal assemblage. Also, adaptability of the transformer to a printed substrate is improved.

4 Claims, 4 Drawing Figures

TRANSFORMER FRAMING STRUCTURE

BACKGROUND OF THE INVENTION

1. Field of the Invention

This invention relates to a transformer framing structure with high dielectric strength and excellent molding and assembling characteristics.

2. Description of the Prior Art

Heretofore, the coil section of the transformer has been constructed by first winding the primary coil on a flangeless bobbin through an interlayer sheet, then winding the secondary coil around said primary coil through an interlayer sheet, and then molding the entirety of this coil assembly with a synthetic resin.

For adapting a terminal to he transformer frame, it has been generally practiced to deform a part of the terminal by pressing it, then insert it into a corresponding hole formed in a flange plate of the frame and secure said terminal in said hole by caulking it.

Such terminal adaptation has been also practiced by first pressing and deforming a part of the terminal and then clamping it between two flange plates of the frame.

However, such conventional way of construction of the transformer coil section was poor in assembling workability as both primary and secondary coils must be wound by interposing an interlayer sheet therebetween. Also, such construction has low dielectric strength because the primary and secondary coils are insulated by the interlayer sheet.

Further, the conventional terminal mounting structure was not easy to assemble.

SUMMARY OF THE INVENTION

This invention has for its object to provide an improved transformer framing structure in which the distance between the opposing end faces of the primary and secondary coils of the transformer is increased to improve the dielectric strength of the transformer.

Another object of this invention is to provide a transformer framework in which the primary and secondary coils are framed by separate framing units to allow winding of said coils separately to thereby improve assembling workability.

Still another object of this invention is to provide a transformer framing structure which requires a reduced number of molding dies for molding the frame body, bobbin assembly and cover of the framing structure.

Still another object of this invention is to provide a transformer frame which allows easy mounting of terminals.

It is a further object of this invention to provide a transformer frame which can be easily adapted to a printed substrate.

In order to accomplish said objects, this invention provides a transformer framing structure comprising: a frame body including a base plate which has provided centrally thereof a trapezoidal raised-up portion extending through said base plate and forming therein a channel also running through said base plate, and an upright prismatic member provided at the center of said trapezoidal portion, with the hollow of said prismatic member being in communication with said channel, said prismatic member being enclosed by an upright wall provided outside of and spaced-apart from said prismatic member, said surrounding wall being provided with flanges at its both upper and lower ends; a bobbin assembly comprising an upright prismatic portion provided with flanges at its upper and lower ends and also provided at its lower end with the legs joined to the respective support plates, said bobbin assembly being adapted to wind thereon a coil to be housed in a coil chamber formed between said prismatic member and its surrounding wall; and a cover consisting of a top cover portion provided at an end of a prismatic structure provided in opposition to said prismatic member of said frame body and a side cover portion extending down vertically from the outer edge of said top cover portion, said cover being adapted to encompass said frame body and said bobbin assembly.

DESCRIPTION OF PREFERRED EMBODIMENTS

Figure 1:
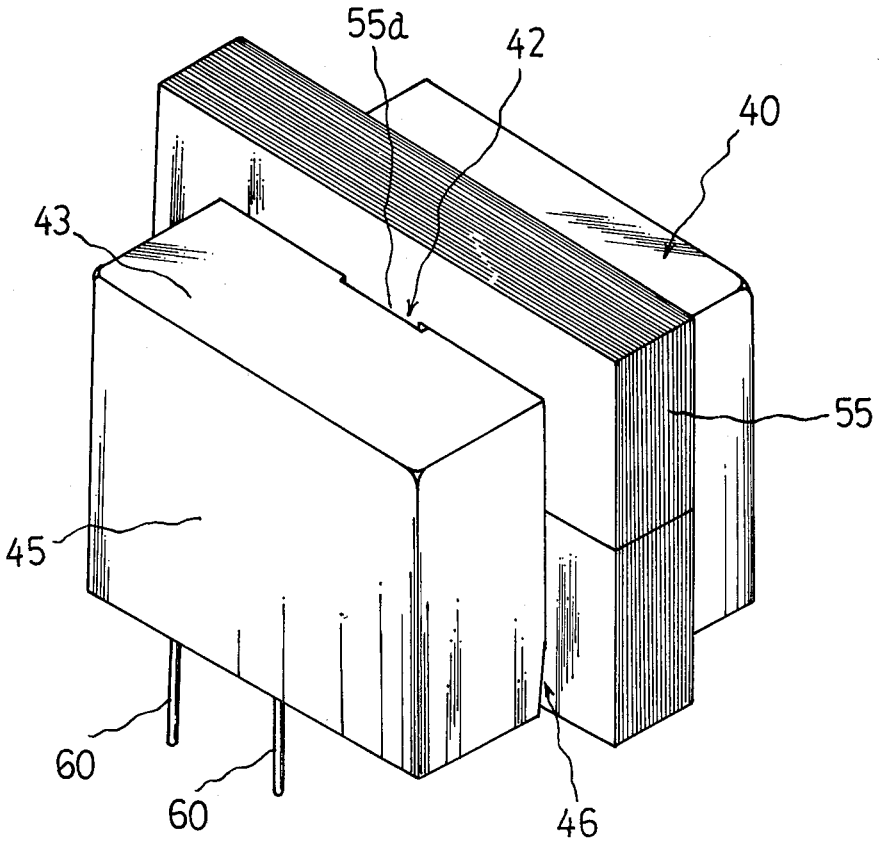
FIG. 1 is a general perspective view of a transformer adapted with a framing structure according to this invention.
Figure 2:
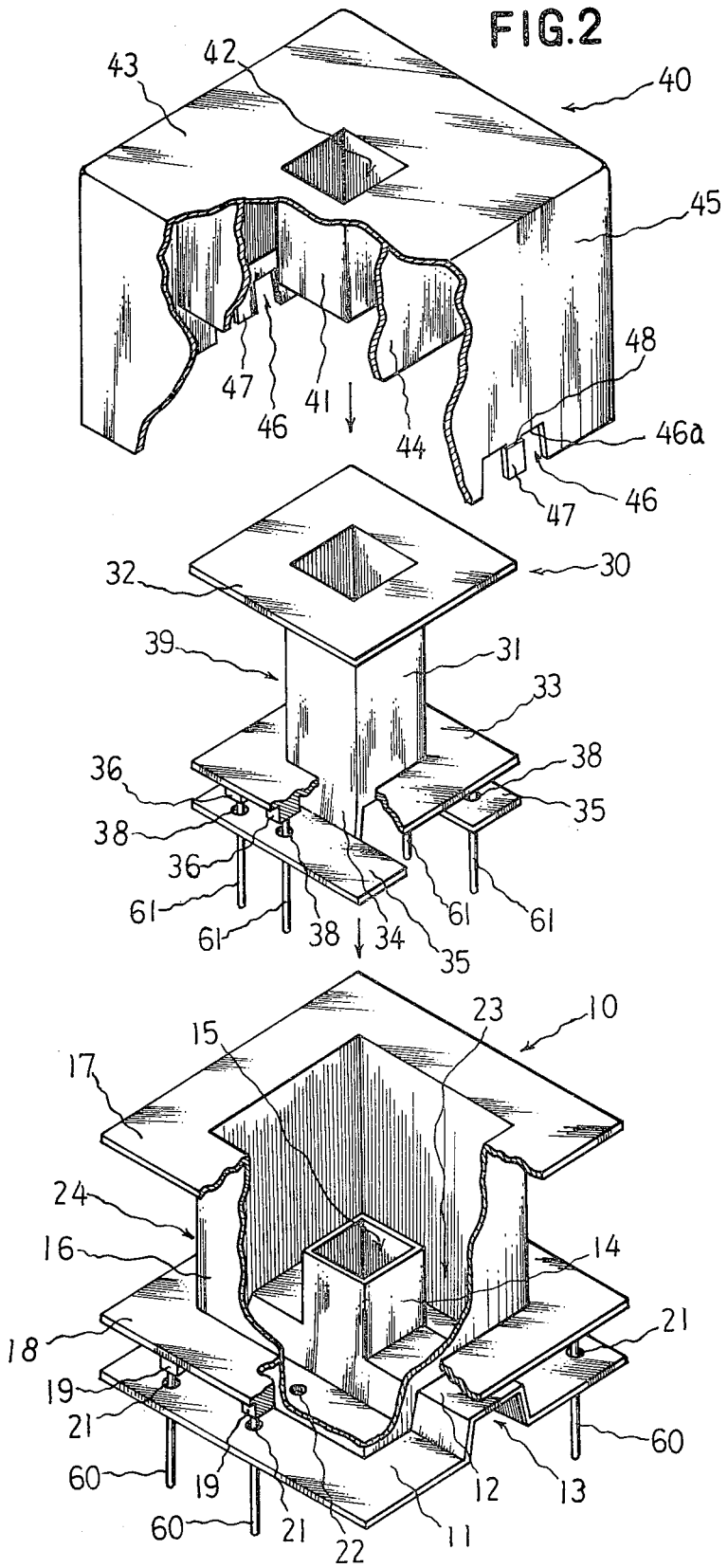
FIG. 2 is a partly cut-out exploded perspective view of a framing structure according to this invention.
Figure 3:
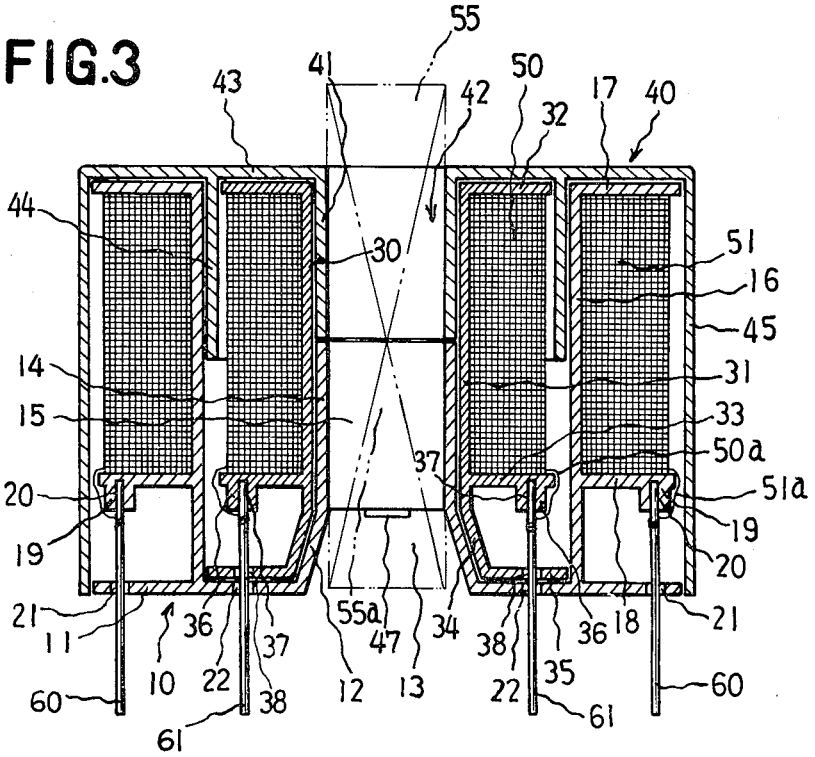
FIG. 3 is a sectional view of a transformer using a framing structure according to this invention as taken by cutting the transformer vertically to the core.
Figure 4:
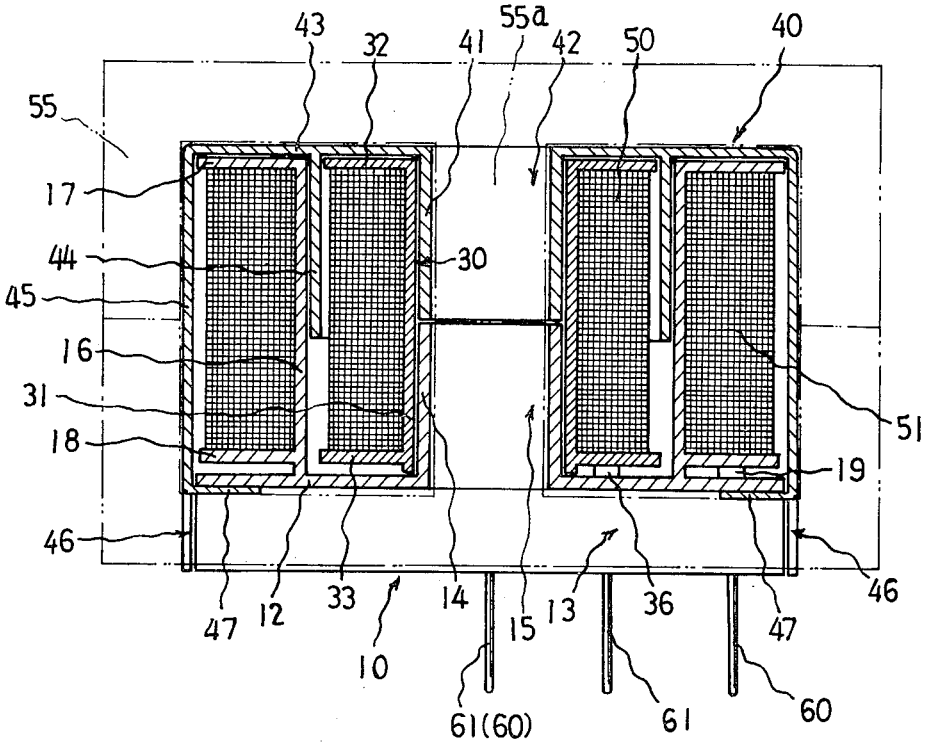
FIG. 4 is a similar sectional view as taken by cutting the transformer in the direction of its core.

The transformer framing structure according to this invention comprises essentially a frame body 10, a bobbin assembly 30 and a cover 40.

The frame body 10 constitutes the base of the transformer and is designed to house therein the bobbin 30 on which the primary coil 50 and secondary coil 51 are wound. The frame body 10 includes a base plate 11 which has provided centrally thereof and extending therethrough a trapezoidal raised-up portion 12 forming a channel 13 in which to receive the core 55. At the center of said trapezoidal portion 12 is provided a prismatic member 14 of which the hollow 15 is communicated with said channel 13 and designed to reive the leg 55*a* of the core 55. Said prismatic member 14 is encompassed by a wall 16 erected centrally on the base plate 11, said wall having provided at its upper end an upper flange 17 in opposition to the base plate 11 and at its lower end a lower flange 18 in opposition to said upper flange 17. Toward the ends on the underside of said lower flange 18 are provided the protuberances 19 corresponding in number to the terminals 60 projecting toward the base plate 11, and in each of said protuberances 19 is formed a blind hole 20 into which an end of a terminal 60 is press-fitted. The base plate 11 is also formed with holes 21 in alignment with the respective blind holes 20 for passing the terminals 60. Thus, each of said terminals 60 is first passed through the 21 and then pressed into the blind hole 20 and fixed thereby. It is to be noted that the terminal-passing holes 22 same in number as the terminals 61 provided are also formed in the portion of the base plate 11 which is located between the trapezoidal portion 12 and its surrounding wall 16. The space defined by said prismatic member 14, base plate 11 and wall 16 constitutes a coil chamber 23 for housing the bobbin 30 on which the primary coil 50 has been wound. The secondary coil 51 of the transformer is wound on the portion 24 of the outer periphery of the frame body 10 which is encompassed by the wall 16, upper flange 17 and lower flange 18.

The bobbin 30 is designed to wind thereon the primary coil 50 of the transformer and housed in the coil chamber 23 in the frame body 10. It comprises a prismatic portion 31 provided with the upper flange 31 and lower flange 33 at its both ends. Extending from the bottom end of said prismatic portion 31 are a pair of legs 34, 34 which are secured at their ends to the respective support plates 35, 35 disposed in opposition to the lower flange 33. On the underside of said lower flange 33 are provided the protuberances 36 projecting toward the support plates 35, each of said protuberances 36 being formed with a blind hole 37 into which an end of a terminal 61 is forced. Each support plate 35 is also formed with the terminal-passing holes 38 in alignment with said respective blind holes 37. Said blind holes 37 and through-holes 38 will be in register with the corresponding through-holes 22 when the bobbin 30 is set in position in the coil chamber 23 of the frame body 10. Thus, each terminal 61 is passed through the hole 38 and then pressed into the blind hole 37 for securement. The primary coil 50 of the transformer is wound on the section 39 of the prismatic portion 31 defined by the upper flange 32 and lower flange 33.

The cover 40 is adapted to enclose the entirety of the frame body 10 except for its base plate 11. At the center of the cover 40 is provided a prismatic structure 41 in opposition to the prismatic member 14 of the frame body 10. The leg **55*a* of the core 55 is fitted into the hollow portion 42 of said prismatic structure 41. The top cover portion 43 is provided at the upper end of said prismatic structure 41, and centrally on the underside of said top cover portion 43 is provided an erect wall 44 surrounding said prismatic structure 41 for separating the primary coil 50 and secondary coil 51. Extending vertically from the outer periphery of said top cover portion 43 is a side cover portion 45 which encloses the entirety of the frame body 10 except for its base plate 11. At the center of the lower ends of said side cover portion 45 are formed the cutouts 46, 46 corresponding in position to the trapezoidal portion 12 of the frame body 10 and substantially same in shape as the section of the channel 13 of said trapezoidal portion 12. Extending down from the center of the upper edge 46*a* of each said cutout 46 is a bent-in piece 47 which is to be bent in between the core 55 and the trapezoidal portion 12 of the frame body 10 when the core 55 is mounted in its position in the framework. A bending groove 48 is formed at the joint of said bent-in piece 47 and the side cover portion 45**.

In the shown embodiment, each said bent-in piece 47 is smaller in width than the channel 13 of the trapezoidal portion 12 of the frame body 10, but in an alternative embodiment, each said bent-in piece 47 may be so formed as to have just the same width as the span of said channel 13. In the latter case, since a greater creeping distance is provided between the core and the secondary coil 51, the mechanism is suited for use in a transformer of a higher voltage than the shown embodiment.

According to the framing structure of this invention described above, the secondary coil 51 is wound around the coil-winding portion 24 of the frame body 10, with the ends **51*a* of said secondary coil 51 being connected to the corresponding terminals 60 secured to the lower flange 18, while the primary coil 50 is wound around the coil-winding portion 39 of the bobbin 30, with the coil ends 50*a* being connected to the respective terminals 61 secured to the lower flange 33, said terminals 61 being passed through the respective holes 22 formed in the base plate 11 in the coil chamber 23 of the frame body 10. The bobbin 30 is housed in the coil chamber 23 of the frame body 10 and the frame body 10 is enclosed by the cover 40. Also, a pair of E-shaped core members 55 are fitted in the hollow portions 15, 42 and channel 13 and the bent-in pieces 47, 47 of the cover 40 are bent in between the core 55 and the trapezoidal portion 12 of the frame body 10 to thereby secure the cover 40 to the frame body 10**.

What is claimed is:

1. A transformer framing structure comprising a frame body including a base plate having provided centrally thereof a trapezoidal raised-up portion forming a channel extending through said base plate, and a prismatic portion provided at the center of said trapezoidal portion, with the hollow of said prismatic portion being in communication with said channel, said prismatic portion being enclosed by a wall erected on said base plate outside of and spaced-apart from said prismatic portion, said enclosing wall being provided with the upper and lower flanges at its both ends; a bobbin assembly comprising a prismatic portion provided with the upper and lower flanges at its upper and lower ends respectively, said prismatic portion having legs extending down from the lower end thereof and joined to the respective support plates, said bobbin assembly being designed to wind thereon the coil to be housed in a coil chamber defined between the prismatic portion of said frame body and the surrounding wall; and a cover for enclosing said frame body and bobbin assembly, said cover comprising a top cover portion provided at an end of a prismatic structure disposed in opposition to the prismatic portion of said frame body and a side cover portion extending down vertically from the outer periphery of said top cover portion.

2. A transformer framing structure according to claim 1, wherein a desired number of terminal press-fitting blind holes are provided on the side of the lower flange of the frame body opposed to the base plate and on the side of the lower flange of the bobbin opposed to the support plates, and said base plate and support plates are also formed with the terminal-passing holes in alignment with said respective blind holes so that a desired number of terminals are passed through said respective holes and press-fitted into said respective blind holes.

3. A transformer framing structure according to claim 1, wherein the prismatic portion of said cover is encompassed by a wall provided extending down vertically from the underside of the top cover portion while spaced-apart from said prismatic portion and in contact with the similar surrounding wall of the frame body.

4. A transformer framing structure according to claim 3, wherein said side cover portion is formed with a pair of cutouts centrally at its lower end contacting the end of the trapezoidal portion of the frame body, said cutouts being substantially same in shape as the section of the channel formed by said trapezoidal portion, and a bent-in piece having a bent-in groove is provided at the top edge of each said cutout, each said bent-in piece being formed integral with the side cover portion.

* * * * *